US006749272B2

(12) United States Patent
Uchiyama et al.

(10) Patent No.: US 6,749,272 B2
(45) Date of Patent: Jun. 15, 2004

(54) ROTARY PUMP WITH HIGHER DISCHARGE PRESSURE AND BRAKE APPARATUS HAVING SAME

(75) Inventors: Kazunori Uchiyama, Nishio (JP); Naoki Hakamada, Anjo (JP); Takahiro Yamaguchi, Kariya (JP); Takashi Satou, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/214,443

(22) Filed: Aug. 8, 2002

(65) Prior Publication Data

US 2003/0031578 A1 Feb. 13, 2003

(30) Foreign Application Priority Data

Aug. 9, 2001 (JP) ..... 2001-242672

(51) Int. Cl.[7] ..... B60T 8/40

(52) U.S. Cl. ..... 303/116.4; 303/10; 418/135; 418/171

(58) Field of Search ..... 303/10, 116.4, 303/DIG. 10; 418/166, 135, 144, 171

(56) References Cited

U.S. PATENT DOCUMENTS

| | | | | |
|---|---|---|---|---|
| 5,335,640 A | * | 8/1994 | Feuling | 123/559.1 |
| 6,250,900 B1 | * | 6/2001 | Gostomski | 418/178 |
| 6,273,527 B1 | | 8/2001 | Yamaguchi et al. | |
| 6,402,488 B2 | * | 6/2002 | Watanabe et al. | 418/178 |

* cited by examiner

*Primary Examiner*—Douglas C. Butler
*Assistant Examiner*—Bradley King
(74) *Attorney, Agent, or Firm*—Posz & Bethards, PLC

(57) ABSTRACT

In a rotary pump in which axial end surfaces of outer and inner rotors is in pressurized direct contact with an axial end surface of a second side plate to form a mechanical sealing, both of the axial end surfaces of the outer and inner rotors and the axial end surface of the second side plate are provided with radial line grinding stripes. Teeth gap portions formed by the outer and inner rotors in mesh communicate with an outer circumference gap between the circumference of the outer rotor and inner circumference of a center plate and also with a shaft hole of the inner rotor through extremely slight gaps formed by concave and convex of the radial line grinding stripes so that contact surface between the outer and inner rotors and the second side plate is well lubricated to reduce torque loss.

7 Claims, 8 Drawing Sheets

ROTARY PUMP WITH HIGHER DISCHARGE PRESSURE AND BRAKE APPARATUS HAVING SAME

CROSS REFERENCE TO RELATED APPLICATION

This application is based upon and claims the benefit of priority of Japanese Patent Application No. 2001-242672 filed on Aug. 9, 2001, the content of which is incorporated herein by reference.

BACKGROUND OF THE INVENTION

1. Field of the Invention

The present invention relates to a rotary pump, in particular, an internal gear pump such as a trochoid pump with higher discharge pressure and a brake apparatus having the same.

2. Description of Related Art

JP-A-2000-179466 shows a rotary pump, as an internal gear pump such as a trochoid pump or the like. The rotary pump is comprised of a drive shaft, an inner rotor having outer teeth portions and an outer rotor having inner teeth portions and a casing for containing the inner and outer rotors. The inner and outer rotors contained in the casing form a plurality of teeth gap portions surrounded by inner teeth portions of the outer rotor and outer teeth portions of the inner rotor which are in mesh with each other.

An intake port and a discharge port are separately disposed on opposite sides of a pump center line passing through the respective rotation axes of the inner and outer rotors. When the drive shaft is rotated for driving the pump, the inner rotor is rotated by the drive shaft on an axis of the drive shaft and, according to the rotation of the inner rotor, the outer rotor is rotated in the same direction. As the respective volumes of the teeth gap portions between the inner and outer teeth portions are varied every turn of the rotating inner and outer rotors, fluid is sucked from the intake port and discharged to the discharge port.

In the conventional rotary pump mentioned above, there is provided two side sealing members one of which seals an upper side clearance between the axial end surfaces of the rotors and the casing and the other of which seals a lower side clearance therebetween. Each of the side sealing members is composed of a resin member and an elastic member such as rubber which urges the resin member toward the outer and inner rotors.

It is not preferable from a cost standpoint to apply two pieces of the side sealing member, which are relatively expensive, to the rotary pump. Accordingly, it is contemplated that one of the upper and lower side clearances is sealed by the conventional resin side sealing member and the other of the upper and lower side clearances is sealed with mechanical sealing due to a direct contact between the axial end surfaces of the rotors and the casing.

For a purpose of assuring the mechanical sealing, it is necessary for the axial end surfaces of the rotors that are made of metal to be strongly pressed against the axial end surface of the casing that is also made of metal. If the contact frictional resistance is larger and, thus, torque loss is larger, a body of the rotary pump has to be larger to secure a given discharge output of the pump.

Further, if the sliding contact surface between the axial end surfaces of the rotors and the casing has a portion where the torque loss is relatively larger and another portion where the torque loss is not so large, frictional heat generated at the portion where the torque loss is large causes to expand metal material of the rotors and the casing, when the pump is rotated at high speed for a long time, so that the discharge output of the pump is damaged and deteriorated.

In the conventional rotary pump, the axial end surfaces of the outer and inner rotors and the axial end surface of a side plate, which are opposed to each other, are provided with parallel straight line gliding stripes formed by flat face grinding. If the axial end surfaces of outer and inner rotors and the side plate having the parallel straight line grinding stripes are in pressurized direct contact with each other for the mechanical sealing, there exist local portions of the sliding contact surface therebetween where the frictional resistance are larger and the torque loss are larger.

In a case as a typical example, as shown in FIG. 9, that an entire axial end surface of the side plate is provided with parallel straight line grinding stripes extending straight in parallel in a direction of connecting an intake port and a discharge port and entire axial end surfaces of the outer and inner rotors are also provided with parallel straight line grinding stripes, at a pair of arch shaped portions of the side plate positioned above a maximum volume closed teeth gap portion and below a minimum volume closed teeth gap portion in FIG. 9, lines of the parallel straight line grinding stripes extend straight in parallel without crossing the teeth gap portions formed by the outer and inner rotors in mech. Accordingly, fluid hardly flows from the teeth gap portions to these arch shaped portions through extremely slight gaps formed by slight concave and convex of the sliding stripes of the side plate.

On the other hand, there also exist a pair of arch shaped portions of the outer rotor where lines of the parallel straight line grinding stripes extend straight in parallel without crossing the teeth gap portions. Accordingly, when the lines of the parallel straight line grinding stripes of the side plate coincide with the lines of the parallel straight line grinding stripes according to the rotation of the rotors, that is, when the arch shaped portions of the side plate and the outer rotor are completely overlapped with each other, fluid lubrication is very poor at the arch shaped portions overlapped, since the extremely slight gaps formed by the sliding stripes of the side plate and the outer rotor do not communicate with the teeth gap portions. As the outer rotor rotate, the lines of the parallel straight line grinding stripes of the side plate and the outer rotor come to cross each other. However, the lines of the parallel straight line grinding stripes of the outer rotor that extend so as to cross the teeth gap portions gradually cross the lines of the parallel straight line grinding stripes on the arch shaped portion of the side plate. Therefore, fluid lubrication on the arch shaped portion of the side pate is inherently poor and the torque loss at the arch shaped portion is larger as shown in FIG. 9.

Torque loss is relatively small, as shown in FIG. 9, at contact surface portions of the side plate other than the arch shaped portions thereof, that is, at portions radially outside the teeth gap portions and perpendicular to a line of connecting the arch shaped portions, since the lines of the parallel straight line grinding stripes extend so as to always cross the teeth gap portions at these portions, irrelevant to the rotation angle of the outer rotor.

Further, if the axial end surfaces of the side plate and the outer rotor are provided with circumferential line grinding stripes, majority lines of the circumferential line grinding stripes at the contact surface between the side plate and the outer rotor do not extend to cross the teeth gap portions so that the fluid lubrication is very poor and the torque loss is larger on the contact surface therebetween.

The portions where the torque loss is larger are confirmed by extensive experimental tests of the present inventors from standpoints that larger torque results in larger heat generation and smaller torque in smaller heat generation, when the outer and inner rotors rotate, since, if the contact surfaces between the side plate and the outer and inner rotors are well lubricated by the fluid, the frictional resistance of the contact surfaces is smaller with less frictional heat and, if the contact surfaces are not well lubricated, the frictional resistance thereof is larger with more frictional heat.

SUMMARY OF THE INVENTION

An object of the present invention is to provide a rotary pump in which axial end surfaces of outer and inner rotors are in direct contact with an axial end surface of side plate (inner side surface of a casing) with less and/or uniform torque loss.

It is another object of the present invention to provide a brake apparatus having a hydraulic circuit in which the rotary pump mentioned above is disposed.

To achieve the object mentioned above, the rotary pump has an outer rotor provided at an inner circumference thereof with inner teeth, an inner rotor provided at an outer circumference thereof with outer teeth in mesh with the inner teeth so as to constitute a plurality of teeth gap portions including a first closed gap portion whose teeth gap volume is nearly largest and a second closed gap portion whose teeth gap volume is nearly smallest, a drive shaft fitted to the inner rotor for rotating the inner rotor, and a casing provided with intake and discharge ports and a rotor room in which the inner and outer rotors are rotatably contained in such a manner that first and second inner side surfaces of the rotor room face first and second axial end surfaces of the outer and inner rotors, respectively, with a circumference gap between an inner circumferential surface of the pump room and an outer circumferential surface of the outer rotor, and the intake and discharge ports communicate with the teeth gap portions so that fluid is sucked from the intake port and discharged from the discharge port when the drive shaft is driven. The rotary pump further has a side sealing member disposed between the first axial end surfaces of the outer and inner rotors and the first inner side surface of the pump room to urge the outer and inner rotors toward the second inner side surface of the pump room so that not only a side clearance between the first axial end surfaces of the outer and inner rotors and the first inner side surface of the pump room is sealed but also a side clearance between the second axial end surfaces of the outer and inner rotors and the second inner side surface of the pump room is sealed with a mechanical seal due to direct contact therebetween.

With the rotary pump mentioned above, both of the second axial end surfaces of the outer and inner rotors and the second inner side surface of the pump room are provided on entire surfaces thereof with radial line grinding stripes.

The radial line grinding stripes serves not only to lubricate the contact surface between the second axial end surfaces of the outer and inner rotors and the second inner side surface of the pump room through extremely slight gaps radially extending and always communicating with the teeth gap portions and the outer circumference gap but also to lubricate the contact surface through the extremely slight gaps with fluid receiving a centrifugal force acting radially according to the rotation of the outer and inner rotors. Accordingly, the frictional resistance and the torque loss at the contact surface are smaller.

As an alternative, in the rotary pump in which the second inner side surface of the pump room is provided with parallel straight line grinding stripes extending straight in parallel in a direction of connecting the intake port and the discharge port and the second axial end surfaces of the outer and inner rotors are also provided with parallel straight line grinding stripes, the second inner side surface of the pump room may be further provided in a vicinity of first and second closed gap portions with fluid grooves communicating with the outer circumference gap but not communicating with the teeth gap portions.

The fluid grooves serve to reduce an area of portions (arch shaped portions mentioned above) of the contact surface between the casing and the outer rotor where the frictional resistance is higher so that torque loss at these portions is reduced.

Further, as another alternative, the rotary pump may has an structure that one of the second axial end surfaces of the outer and inner rotors and the second inner side surface of the pump room is provided with radial line grinding stripes and the other thereof is provided with circumferential line grinding stripes.

In this case, contact frictional resistance at any portion of the contact surface between the outer and inner rotors and the pump room in any rotating phase is smaller, since there exist no arch shaped portions which the conventional rotary pump has and adequate size of extremely slight gaps are formed by the radial line and circumferential line grinding stripes whose lines always cross perpendicularly to each other, resulting in less frictional resistance and torque loss.

The radial line grinding stripes may be lines extending radially straight. In this case, the fuel can effectively flow along these lines due to the centrifugal force applied thereto.

The radial line grinding stripes may be lines extending radially in a curve. These curved lines can be easily formed when the outer and/or inner rotors or the pump room move relative to the grindstone whose curvature radius is relatively small.

Each line of the radial line grinding stripes of the pump room is curved in a direction opposite to each line of the radial line grinding stripes of the axial end surfaces of the outer and inner rotors.

One side of the radial line grinding stripes of the second axial end surfaces of the outer and inner rotors and the radial line grinding stripes of the second inner side surface of the pump room extend radially in straight and the other side thereof extend radially in a curve. The one side of the radial line grinding stripes may extend from a first center point radially outward in a curve and the other side thereof extend from a second center point, which is not coincident with the first center point, radially outward in a curve.

Furthermore, in the rotary pump in which the second axial end surface of the outer rotor and the second inner side surface of the pump room are provided on entire surfaces thereof with parallel straight line grinding stripes so that directions in which the parallel straight line grinding stripes of the second axial end surface of the outer rotor and the second inner side surface of the pump room coincide with each other in every half rotation of the outer rotor in the pump room, at least one of the second axial end surface of the outer rotor and the second inner side surface of the pump room may be provided at arch shaped positions, where each line of the parallel straight line grinding stripes penetrates in straight from a point of the outer circumference gap to another point thereof without crossing the teeth gap portions, with fluid grooves communicating with the outer circumference gap but not communicating with the teeth gap portions.

In this case, even if the arch shaped positions of the pump room are overlapped with the arch shaped position of the outer rotor according to the rotation of the outer rotor, an area of contact surface between the arch shaped positions of the pump room and the outer rotor is smaller due to the fluid grooves formed at one of the arch shaped positions thereof so that frictional resistance on these arch shaped positions is smaller, resulting in less torque loss. The arch shaped positions of the pump room in this case where the torque loss is higher are not limited to positions radially outside the first and second closed teeth gap portions, as shown in FIG. 9, but may be the other portions depending on line directions of the parallel straight grinding stripes on the pump room.

Moreover, in a rotary pump having an outer rotor provided at an inner circumference thereof with inner teeth, an inner rotor provided at an outer circumference thereof with outer teeth in mesh with the inner teeth so as to constitute a plurality of teeth gap portions, a drive shaft fitted to the inner rotor for rotating the inner rotor, a casing provided with intake and discharge ports and a rotor room in which the inner and outer rotors are rotatably contained with an outer circumference gap between an inner circumferential surface of the rotor room and an outer circumferential surface of the outer rotor in such a manner that at least one of opposite side axial end surfaces of the outer and inner rotors are in pressurized direct contact with toward one of opposite side inner side surfaces of the pump room to form a mechanical sealing and the intake port communicates with a first group of the teeth gap portions positioned between the second and first closed gap portions and the discharge port communicates with a second group of the teeth gap portions positioned between the first and second closed gap portions so that fluid is sucked from the intake port and discharged from the discharge port when the drive shaft is driven, and a circumference sealing member disposed in the outer circumference gap to divide the outer circumference gap into high and low pressure regions communicating with the intake and discharge ports, respectively, the one of the opposite side inner side surfaces of the pump room may be provided with a fluid groove communicating with the one of the high and low pressure regions but neither communicating with the other of the high and low pressure regions nor the teeth gap portions.

According to the rotary pump mentioned above, the fluid groove is provided, irrelevant to directions in which lines of the grinding stripes extend, to reduce an area of the contact surface between the pump room and the outer rotor so that the fluid groove serves to reduce the frictional resistance and the torque loss at the contact surface therebetween.

It is preferable, in this case, that the fluid groove is positioned radially outside the second group of the teeth gap portions communicating with the discharge port and radially inside the high pressure region of the outer circumference gap.

In a side clearance sealed by the mechanical sealing, fluid tends to flow from the high pressure region of the outer circumference gap or the second group of the teeth gap portion toward the first group of the teeth gap portions and the low pressure region of the outer circumference gap, due to pressure difference therebetween. However, the fluid hardly flows from the high pressure region of the outer circumference gap toward the second group of the teeth gap portion, because of on pressure difference therebetween, except the fluid movement along the lines of the grinding stripes or due to the centrifugal force acting radially. therefore, the fluid groove, which is formed at a position where the lubrication is very poor and the frictional resistance is higher, serves to reduce a contact surface between the pump room and the outer rotor and reduce the torque loss at this position.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Preferred embodiments of the present invention are described with reference to figures attached hereto.

(First embodiment)

Figure 1:
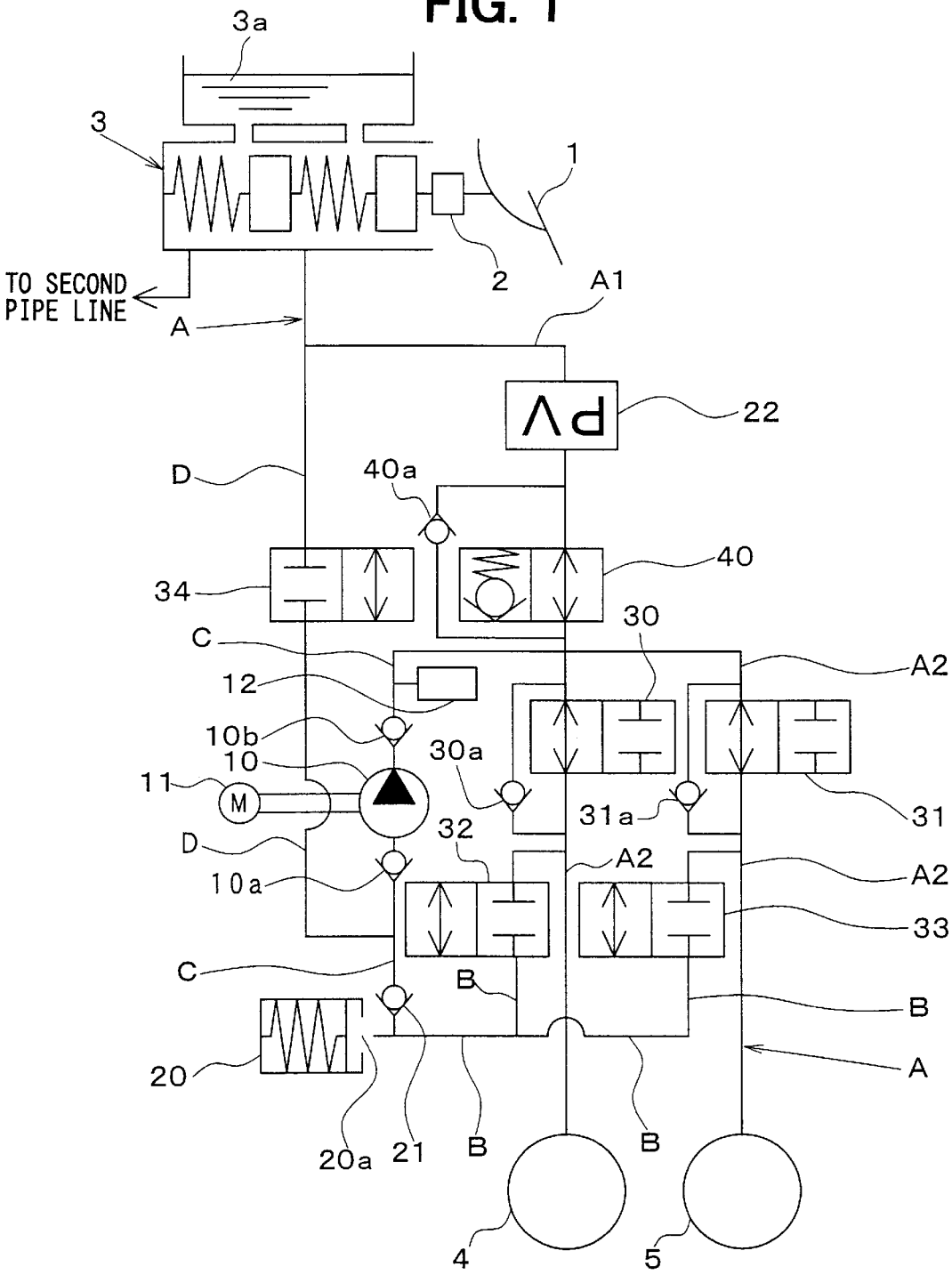
FIG. 1 is an outline of a piping system of a brake apparatus with a rotary pump according to a first embodiment.

FIG. 1 shows an outline of a piping system of a brake apparatus to which a trochoid pump as a rotary pump is applied. The basic composition of the brake apparatus will be described with reference to FIG. 1. In this embodiment, a brake apparatus is applied to a vehicle provided with a hydraulic circuit of a diagonal piping system having a first conduit connecting wheel cylinders of a front right wheel and a rear left wheel and a second conduit connecting wheel cylinders of a front left wheel and a rear right wheel. The vehicle is a four wheel vehicle of front wheel drive.

As shown in FIG. 1, a brake pedal 1 is connected to a booster 2. The booster 2 boosts brake depression force.

Further, the booster 2 is provided with a rod for transmitting boosted depression force to a master cylinder 3. The master cylinder 3 generates master cylinder pressure when the rod pushes a master piston arranged in the master cylinder 3. The brake pedal 1, the booster 2 and the master cylinder 3 correspond to a brake fluid pressure generating device.

The master cylinder 3 is provided with a master reservoir 3*a* for supplying brake fluid into the master cylinder 3 or storing extra brake fluid of the master cylinder 3.

Further, the master cylinder pressure is transmitted to a wheel cylinder 4 for a front right wheel (FR) and a wheel cylinder 5 for a rear left wheel (RL) via a brake assist system provided with a function of an antilock brake system (hereinafter, referred to ABS). In the following explanation, the brake apparatus will be described with respect to the hydraulic circuit in the first conduit connecting the wheel cylinders of the front right wheel (FR) and the rear left wheel (RL). The explanation for the second conduit connecting the wheel cylinders of the front left wheel (FL) and the rear right wheel (RR) will be omitted since the hydraulic circuit in the second conduit is quite similar to that in the first conduit.

The brake apparatus is provided with a conduit (main conduit) A connected to the master cylinder 3. A proportioning valve (PV) 22 is disposed in the main conduit A. The main conduit A. is divided into two portions by the proportioning valve 22. That is, the main conduit A is divided into a first conduit A1 extending from the master cylinder 3 to the proportioning valve 22 and a second conduit A2 extending from the proportioning valve 22 to the respective wheel cylinders 4 and 5.

The proportioning valve 22 has a function of transmitting a reference pressure of a brake fluid to the downstream side with a predetermined attenuation rate when the braking fluid flows in the positive direction. That is, by inversely connecting the proportioning valve 22 as shown in FIG. 1, pressure of the brake fluid on the side of the second conduit A2 becomes the reference pressure.

Further, the second conduit A2 branches out two conduits. A pressure increase control valve 30 for controlling an increase of brake fluid pressure of the wheel cylinder 4 is installed to one of the branched conduits and a pressure increase control valve 31 for controlling an increase of brake fluid pressure of the wheel cylinder 5 is installed to the other thereof.

The pressure increase control valve 30 or 31 is a two-position valve capable of controlling communication and shut-off states by an electronic control unit (hereinafter, referred to as ECU). When the two-position valve is controlled to a communicating state, the master cylinder pressure or the brake fluid pressure produced by a pump 10 can be applied to the respective wheel cylinders 4 and 5. In the normal braking operation where ABS is not controlled by ECU, each of the pressure increase control valves 30 and 31 is always controlled in the communicating state.

Safety valves 30*a* and 31*a* are installed in parallel to the pressure increase control valves 30 and 31, respectively. The safety valve 30*a* or 31*a* allows the brake fluid to swiftly return from the wheel cylinder 4 or 5 to the master cylinder 3 when ABS control has been finished by stopping depression of the brake pedal 1.

Pressure reduction control valve 32 or 33 capable of controlling communication and shut-off states by ECU is arranged at a conduit B connecting the second conduit A2 between the pressure increase control valve 30 or 31 and the wheel cylinder 4 or 5, and a reservoir port 20*a* of a reservoir 20. In the normal braking operation, the pressure reduction control valves 32 and 33 are always brought into a cut-off state.

A rotary pump 10 is arranged at a conduit C connecting the reservoir hole 20*a* of the reservoir 20 and the second conduit A2 between the proportioning valve 22 and the pressure increase control valve 30 or 31. Safety valves 10*a* and 10*b* are disposed in the conduit C on both sides of the rotary pump 10. A motor 11 is connected to the rotary pump 10 to drive the rotary pump 10. A detailed explanation of the rotary pump 10 will be given later.

A damper 12 is arranged on the discharge side of the rotary pump 10 in the conduit C to alleviate pulsation of the brake fluid delivered by the rotary pump 10. An auxiliary conduit D is installed to connect the conduit C between the reservoir 20 and the rotary pump 10, and the master cylinder 3. The rotary pump 10 sucks the brake fluid of the first conduit A1 via the auxiliary conduit D and discharges it to the second conduit A2, whereby the brake fluid pressures of the wheel cylinders 4 and 5 are made higher than the master cylinder pressure. As a result, wheel braking forces of the wheel cylinders 4 and 5 are increased. The proportioning valve 22 works to hold the pressure difference between the master cylinder pressure and the wheel cylinder pressure.

A control valve 34 is installed in the auxiliary conduit D. The control valve 34 is always brought into cut-off state in the normal braking operation.

A check valve 21 is arranged between a connection point of the conduit C and the auxiliary conduit D and the reservoir 20 to prevent the brake fluid drawn via the auxiliary conduit D from flowing in a reverse direction to the reservoir 20.

A control valve 40 is disposed between the proportioning valve 22 and the pressure increase control valve 30 or 31 in the second conduit A2. The control valve 40 is a two position valve and normally controlled in communicating state. However, the control valve 40 is switched to a differential pressure producing state to hold the pressure difference between the master cylinder pressure and the wheel cylinder pressure, when the vehicle is braked in panic or traction control is carried out so that the brake fluid pressure of the wheel cylinders 4 and 5 may be controlled to become higher than the master cylinder pressure.

Figure 2:
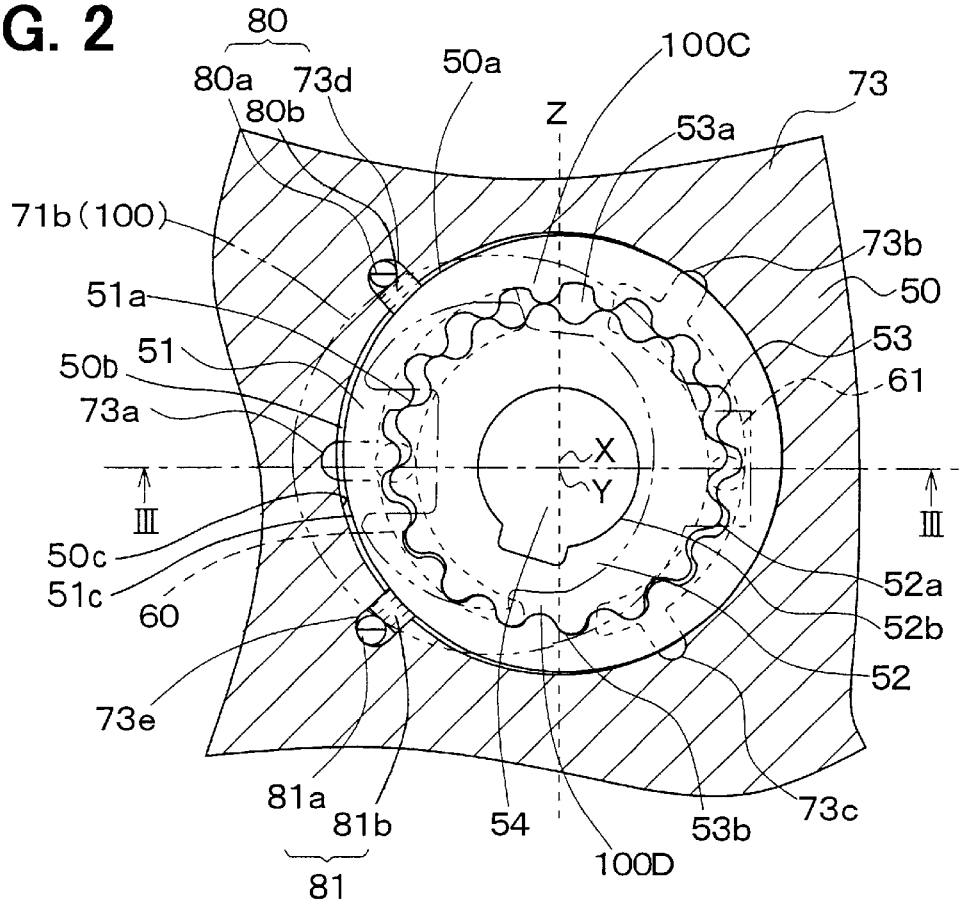
FIG. 2 is a sectional view of the rotary pump of FIG. 1.
Figure 3:
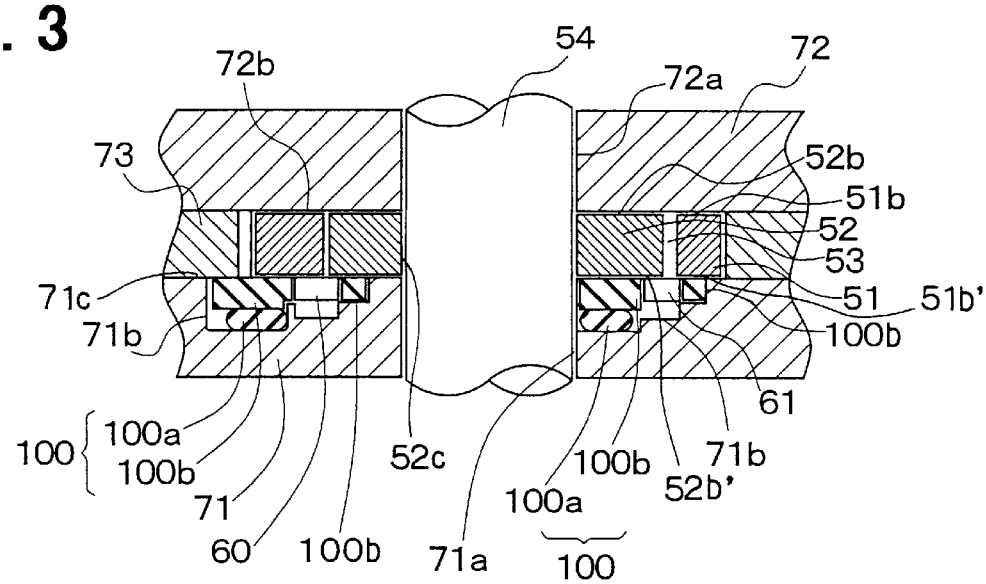
FIG. 3 is a sectional view taken along a line III—III of FIG. 2.

FIG. 2 shows a schematic sectional view of the rotary pump 10. FIG. 3 shows a sectional view taken along a line III—III of FIG. 2. First, the structure of the rotary pump 10 will be described with reference to FIGS. 2 and 3.

An outer rotor 51 and an inner rotor 52 are contained in a rotor room 50*a* of the casing 50 of the rotary pump 10. The outer rotor 51 and the inner rotor 52 are assembled in the casing 50 in a state where respective center axes (point X and point Y in the drawing) are shifted from each other. The outer rotor 51 is provided at its inner periphery with an inner teeth portion 51*a*. The inner rotor 52 is provided at its outer periphery with an outer teeth portion 52*a*. The inner teeth portion 51*a* of the outer rotor 51 and the outer teeth portion 52*a* of the inner rotor 52 are in mesh with each other and form a plurality of teeth gap portions 53. As is apparent from FIG. 2, the rotary pump 10 is a multiple teeth trochoid type pump having no partition plates (crescent) in which the teeth gap portions 53 are formed by the inner teeth portion 51*a* of the outer rotor 51 and the outer teeth portion 52*a* of the inner rotor 52. The inner rotor 52 and the outer rotor 51 share a plurality of contact points (that is, contact faces) at the mesh faces in order to transmit rotation torque of the inner rotor 52 to the outer rotor 51.

As shown in FIG. 3, the casing 50 is composed of a first side plate 71 and a second side plate 72 that are placed on opposite sides of the outer and inner rotors 51 and 52, and a center plate 73 placed between the first side plate 71 and the second side plate 72. The center plate 73 is provided with a bore in which the outer and inner rotors 51 and 52 are housed. The first and second side plates 71 and 72 and the center plate 73 constitute the rotor room 50*a* having opposite inner side surfaces and an inner circumferential surface.

The first and second side plates 71 and 72 are respectively provided at their center portions with center bores 71*a* and 72*a* which communicate with the rotor room 50*a*. The drive shaft 54 fitted to the inner rotor 52 is housed in the center bores 71*a* and 72*a*. The outer rotor 51 and the inner rotor 52 are rotatably arranged in the bore of the center plate 73. That is, a rotating unit constituted by the outer rotor 51 and the inner rotor 52 is rotatably contained in the rotor room 50*a* of the casing 50. The outer rotor 51 rotates with a point X as a rotation axis and the inner rotor 52 rotates with a point Y as a rotation axis.

When a line running on both point X and point Y respectively corresponding to the rotation axes of the outer rotor 51 and the inner rotor 52 is defined as a center line Z of the rotary pump 10, the intake port 60 and the discharge port 61 both of which communicate with the rotor room 50*a* are formed on the left and right sides of the center line Z in the first and second side plates 71 and 72. The intake port 60 and the discharge port 61 are arranged respectively at positions communicating with a plurality of teeth gap portions 53. The brake fluid from outside can be sucked into the teeth gap portions 53 via the intake port 60 and the brake fluid in the teeth gap portions 53 can be discharged to outside via the discharge port 61.

There exist a maximum volume closed gap portion (first closed gap portion) 53*a* where the brake fluid volume is the largest and a minimum volume closed gap portion (second closed gap portion) 53*b* where the brake fluid volume is the smallest among the plurality of the teeth gap portions 53. The maximum and minimum volume closed gap portions 53*a* and 53*b* communicate neither with the intake port 60 nor with the discharge port 61. The closed gap portions 53*a* and 53*b* serve to hold pressure difference between the intake pressure at the intake port 60 and the discharge pressure at the discharge port 61.

A ring shaped outer circumference gap 50*b* is formed between an outer circumferential surface 51*c* of the outer rotor 51 and an inner circumferential surface 50*c* of the center plate 73 (pump room 50*a*). The ring shaped outer circumference gap 50*b* is divided into high pressure and low pressure regions by first and second outer circumference sealing members 80 and 81.

The first side plate 71 is provided with a low pressure communicating path 73*a* through which the low pressure outer circumference communicates with the intake port 60, and first and second high pressure communicating paths 73*b* and 73*c* through which the high pressure outer circumference communicates with the discharge port 61. The communicating path 73*a* is arranged at a position advanced in a direction from the center line Z to the intake port 60 by an angle of about 90 degrees centering on the point X constituting the rotation axis of the outer rotor 51.

The first high pressure communicating path 73*b* is formed to cause the teeth gap portion 53, which is most adjacent to the closed gap portion 53*a* among the plurality of teeth gap portions 53 communicating with the discharge port 61, to communicate with the outer circumference of the outer rotor 51. The second high pressure communicating path 73*c* is formed to cause the teeth gap portion 53, which is most adjacent to the closed gap portion 53*b* among the plurality of teeth gap portions 53 communicating with the discharge port 61, to communicate with the outer circumference of the outer rotor 51. Specifically, the first and second high pressure communicating paths 73*b* and 73*c* are arranged respectively at positions advanced in right and left directions from the center line Z to the discharge port 61 by an angle of about 22.5 degrees centering on the point X.

Recessed portions 73*d* and 73*e* are formed on an inner wall of the bore of the center plate 73 at positions advanced in the left and right directions, respectively, from the center line Z to the intake port 60 by an angle of about 45 degrees centering on the point X constituting the rotation axis of the outer rotor 51. The first and second outer circumference sealing members 80 and 81 are respectively installed in the recessed portions 73*a* and 73*b* to restrain the brake fluid from flowing from the high pressure outer circumference to the low pressure outer circumference.

The first outer circumference sealing member 80 is arranged circumferentially at a position between the low pressure communicating path 73*a* and the first high pressure communicating path 73*b*. The second outer circumference sealing member 81 is arranged circumferentially at a position between the low pressure communicating path 73*a* and the second high pressure communicating path 73*c*.

The first or second outer circumference sealing member 80 or 81 is composed of a nearly cylindrical rubber element 80*a* or 81*a* and a rectangular shaped resin element 80*b* or 81*b*. The resin element 80*b* or 81*b* is made of Teflon. The resin element 80*b* or 81*b* is biased or pressed by the rubber element 80*a* or 81*a* to be brought into contact with the outer rotor 51. That is, as the dimensional deviation of the outer rotor 51 due to manufacturing errors or the like is inevitable, the rubber element, 80*a* or 81*a* having elastic force can absorb the dimensional deviation.

As shown in FIG. 3, the first side plate 71 is provided on an axial end surface 71*c* (correspond to one of the inner side surfaces of the pump room 50*a*) with a grooved portion 71*b*. The grooved portion 71*b* is shaped a ring whose width is partly wider at given circumferential positions and formed to surround the drive shaft 54, as shown by a two dots-dash line in FIG. 2. In more detail, the center of the grooved portion 71*b* is positioned eccentrically on a side of the intake port 60 (on a left side of the drawing) with respect to the axial center of the drive shaft 54. The grooved portion 71*b* passes through a portion between the discharge port 61 and the drive shaft 54, the closed gap portions 53*a* and 53*b* and portions where the first and second outer circumference sealing members 80 and 81 seal the outer circumference gap 50*b* outside the outer rotor 51.

The width of the grooved portion 71*b* is locally expanded so that the grooved portion 71*b* hangs over both of the inner rotor 52 and the outer rotor 51 at positions where an extended line connecting the center axis of the drive shaft 54 and a center of the grooved portion 71*b* crosses the intake port 60 and the discharge port 61. Further, the width of the grooved portion 71*b* is also locally expanded so that the grooved portion 71*b* hangs over the closed gap portions 53*a* and 53*b*.

Figure 4:
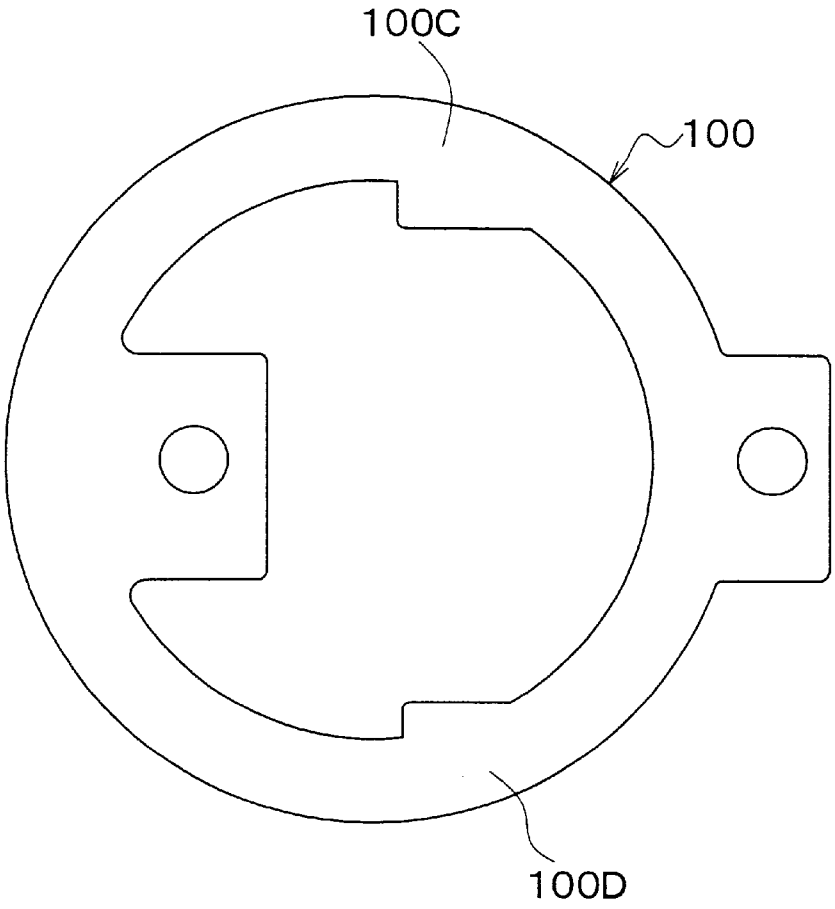
FIG. 4 is a schematic plan view of a side sealing member of the rotary pump according to the first embodiment.
Figure 5:
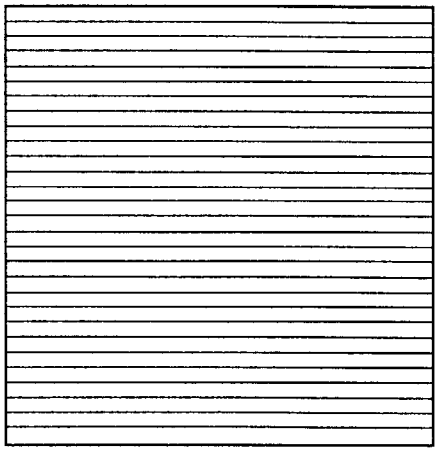
FIG. 5 PRIOR ART
FIG. 5 is a conceptual view showing parallel straight line grinding stripes as a prior art.

A side sealing member 100, whose shape is a ring similar to that of the grooved portion 71*b* as shown in FIG. 4, is housed in the grooved portion 71*b*. A width of the side sealing member 100 is partly wider at given circumferential positions, similarly as the grooved portion 71*b*.

In particular, first and second wider width portions 100C and 100D of the side sealing member 100 cover entirely the closed gap portions 53*a* and 53*b*, respectively, and serve mainly to prevent brake fluid leakage from the closed gap portions 53*a* and 53*b*. The first and second wider width portions 100C and 100D also serve to prevent the inner rotor 52 and the outer rotor 51 from being displaced axially each other.

The side sealing member 100 is composed of an elastic element 100*a* such as rubber and a resin element 100*b*. The resin element 100*b* is arranged to be in contact with axial end surfaces 51*b*', 52*b*' of the inner rotor 52 and the outer rotor 51 and an axial end surface of the center plate 73 and, for performing the sealing function, urged by both of biasing force of the elastic element 100*a* placed on a bottom side of the grooved portion 71*b* with respect to the resin element 100*b* and discharge pressure of the brake fluid introduced into the grooved portion 71*b*. Accordingly, the outer rotor 51 and the inner rotor 52 are urged toward the side plate 72 so that axial end surfaces 51*b* and 52*b* (upper side in FIG. 3) of the outer and inner rotors 51 and 52 come in intimate contact with an axial end surface 72*b* of the side plate 72 (correspond to the other of the inner side surfaces of the pump room 50*a*).

As mentioned above, the side sealing member 100 serve to seal the brake fluid communication between the high pressure discharge port 61 and the low pressure clearance between the drive shaft 54 and the inner rotor 52 or the low pressure intake port 60 through a clearance between each axial end surface (lower side in FIG. 3) of the inner and outer rotors 52 and 51 and the first side plate 71.

To seal effectively the clearance between the each axial end surface of the inner and outer rotors 52 and 51 and the first side plate 71, the side sealing members 100 extends from the first outer circumference sealing member 80 at the outer circumference of the outer rotor 51, via the closed gap portion 53*a*, a portion between the discharge port 61 and a shaft hole 52*c* where the drive shaft 54 is inserted, the closed gap portion 53*b*, to the second outer circumference sealing member 81 at the outer circumference of the outer rotor 51. Sine it is necessary to intensively seal portions where the closed gap portions 53*a* and 53*b* and the first and second circumference sealing members 80 and 81 are positioned, the side sealing member 100 is arranged to be in contact with and press with greater forces the closed gap portions 53*a* and 53*b* and the first and second circumference sealing members 80 and 81. As the side sealing member 100 intensively seals only clearance portions necessary for restraining the brake fluid leakage between high and low pressure portions and, therefore, is in contact only with limited portions of the outer and inner rotors 51 and 52, the contact resistance of the side sealing member 100 with the outer and inner rotors 51 and 52 is smaller so that the mechanical loss may be limited.

On the other hand, as shown in FIG. 3, axial end surfaces 51*b* and 52*b* of the outer and inner rotors 51 and 52 on a side opposite to the side sealing member 100 are urged under high pressure toward the second side plate 72 and in slidable contact with an axial end surface 72*b* of the second side plate 72 to an extent that substantial fluid communication between the high pressure fluid and the low pressure fluid is mechanically sealed.

Figure 6:
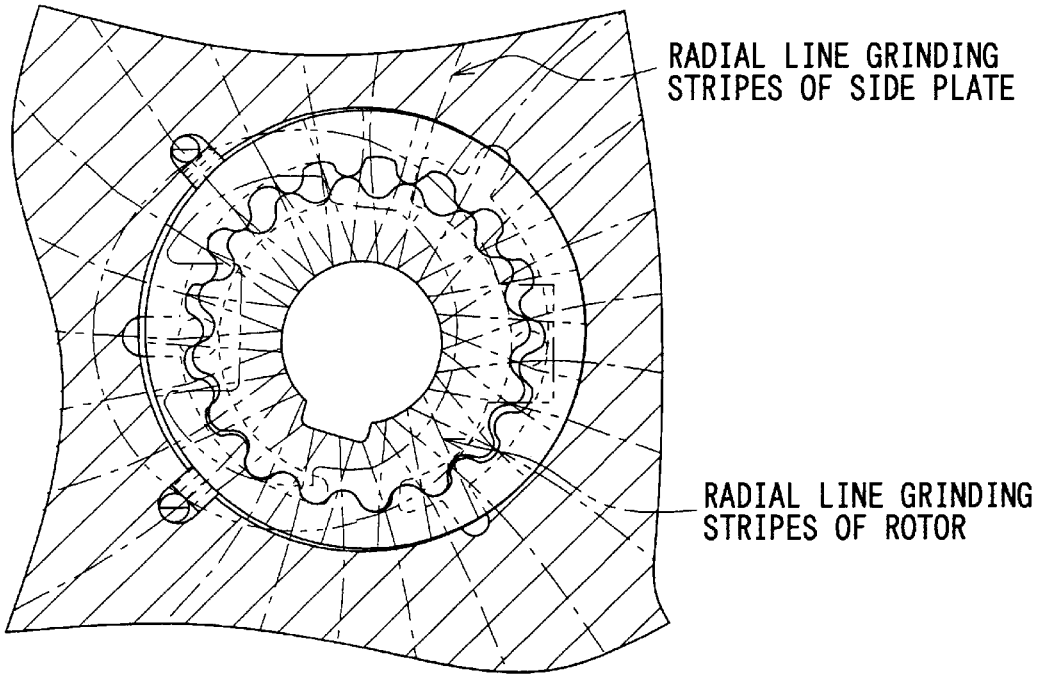
FIG. 6 is a schematic view showing grinding stripes on axial end surfaces of outer and inner rotors and a second side plate according to the first embodiment.

To secure the mechanical sealing, each of the axial end surfaces 51*b* and 52*b* of the outer and inner rotors 51 and 52 and the axial end surface 72*b* of the second side plate 72 are provided with radially extending grinding stripes (grinding traces), as shown in FIG. 6, not normal grinding stripes extending straight in parallel, as shown in FIG. 4 or circumferentially. The radially extending grinding stripes provided on the outer and inner rotors 51 and 52 and the side plate 72 in the first embodiment are composed of a plurality of lines each starting from a point such as a center axis thereof and extending in a curve radially outward.

The radial line grinding stripes are formed in use of a grindstone whose grinding face is shaped circular in such a manner that each of the outer and inner rotors 51 and 52 and the second side plate 72 is rotated at the same time when the grindstone rotates for grinding each of the axial end surfaces 51*b* and 52*b* and the end surface 72*b*. Each curvature degree of the grinding stripes depends on a value of curvature of an outer circumference of the grindstone. As the value of the curvature of the outer circumference of the grindstone is smaller, each curvature of the grinding stripes is smaller. The grinding for the outer and inner rotors 51 and 52 may be performed in a state that the outer and inner rotors 51 and 52 are primarily combined or separated.

Next, an explanation will be given of operations of the brake apparatus and the rotary pump 10.

The control valve 34 provided in the brake apparatus is pertinently brought into a communicating state when high pressure brake fluid needs to be supplied to the wheel cylinders 4 and 5, for example, when braking force in correspondence with depressing force of the brake pedal 1 cannot be obtained or when an operating amount of the braking pedal 1 is large. When the control valve 34 is switched to the communicating state, the master cylinder pressure generated by depressing the brake pedal 1 is applied to the rotary pump 10 via the auxiliary conduit D.

In the rotary pump 10, the inner rotor 52 is rotated in accordance with rotation of the drive shaft 54 by driving the motor 11. In response to rotation of the inner rotor 52, the outer rotor 51 is also rotated in the same direction as the inner teeth portion 51*a* is in mesh with the outer teeth portion 52*a*. At this time, each volume of the teeth gap portions 53 is changed from large to small or vice versa during a cycle in which the outer rotor 51 and the inner rotor 52 make one turn. Therefore, the brake fluid is sucked from the intake port 60 and is discharged from the discharge port 61 to the second conduit A2. Pressures of the wheel cylinders can be increased using the discharged brake fluid.

In this way, the rotary pump 10 can carry out a basic pumping operation in which the brake fluid is sucked from the intake port 60 and is discharged from the discharge port 61 by rotation of the outer and inner rotors 51 and 52.

During the pumping operation, the outer circumference of the outer rotor 51 on a side of the intake port 60 is under intake pressure by brake fluid to be sucked through the low pressure communicating path 73*a* and the outer circumference of the outer rotor 51 on a side of the discharge port 61 is under discharge pressure by brake fluid to be discharged through the high pressure communicating paths 73*b* and 73*c*. Therefore, at the outer circumference of the outer rotor 51, the pressure difference exists between the low pressure region communicating to the intake port 60 and the high pressure region communicating to the discharge port 61. Further, at the clearance between the axial end surfaces 51*b*, 52*b* and 72*b* of the outer and inner rotors 51 and 52 and the first and second side plates 71 and 72, there exist both high and low pressure portions caused by the intake port 60 at low pressure, the clearance at low pressure between the drive shaft 54 and the inner rotor 52, and the discharge port 61 at high pressure.

However, the brake fluid leakage from the high pressure region on a side of the discharge port 61 to the low pressure region on a side of the intake port 60 at the outer circumference gap 50*a* of the outer rotor 51 is prevented by the outer circumference sealing members 80 and 81. Further, the side sealing member 100 seals substantial brake fluid leakage from the high pressure portion to the low pressure portion at the clearance between the axial end surfaces of the inner and outer rotors 52 and 51 and the first side plate 71. A clearance between the side sealing member 100 and the outer and inner rotors 51 and 52, if exist as shown in FIG. 3, disappears, as the pressure of the discharge port 51 becomes higher, since the side sealing member 100 is bent and brought in close contact with the limited portions of the outer and inner rotors 51 and 52 so that the side sealing member 100 plays a role of sealing.

The axial end surfaces 51*b* and 52*b* of the outer and inner rotors 51 and 52 are pressed against the axial end surface 72*b* of the second side plate 72. Accordingly, a direct contact between the axial end surfaces 51*b* and 52*b* and the axial end surface 72*b* serves as a mechanical sealing which prevents substantial fluid leakage from the high pressure region to the low pressure region through a clearance between the axial end surfaces 51*b* and 52*b* and the axial end surface 72*b*.

The outer circumference sealing members 80 and 81 are so operative that the outer circumference gap 50*b* on a side of the intake port 60 is exposed to low pressure which is same to the pressure of the teeth gap portions 53 communicating with the intake port 60 and the outer circumference gap 50*b* on a side of the discharge port 61 may be exposed to high pressure which is same to the pressure of the teeth gap portions 53 communicating with the discharge port 61. As a result, pressures at the outer and inner circumferences of the outer rotor 51 are balanced so that the pump operation becomes stable.

If the axial end surfaces 51*b* and 52*b* come in tighter or closer contact with the axial end surface 72*b*, slide friction between the axial end surfaces 51*b* and 52*b* and the axial end surfaces 72*b* becomes larger, resulting in a torque loss of the pump 10. Accordingly, it is required to have an extremely slight gap between the axial end surfaces 51*b* and 52*b* and the axial end surfaces 72*b* to an extent that contact surface between the outer and inner rotors 51 and 52 and the second side plate 72 can be well lubricated by fluid, though the substantial fluid leakage from the high pressure portions to the low pressure portions is restricted.

Figure 7:
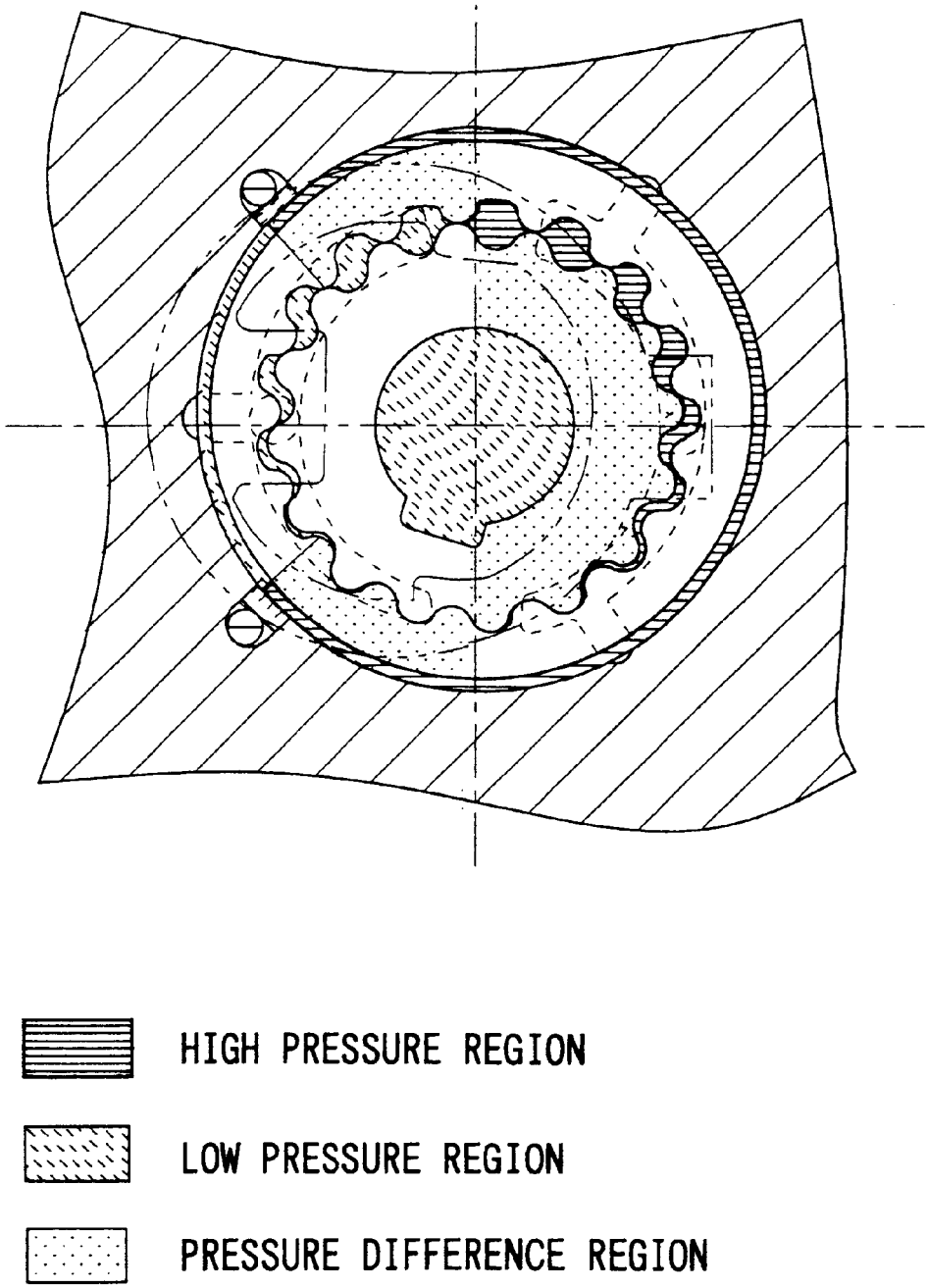
FIG. 7 is a schematic view showing pressure distribution of the rotary pump of FIG. 1.

Since each of the axial end surfaces 51*b* and 52*b* and the axial end surface 72*b* is provided with the grinding stripes extending radially, not the grinding stripe extending straight in parallel or circumferentially, as mentioned above, the outer circumference gap 50*b*, which is formed between the outer circumference of the outer rotor 51 and inner circumference of the rotor room 50*a* of the center plate 73, communicates via extremely slight gaps formed by concave and convex of the grinding stripes with the teeth gap portions 53 between the outer and inner rotors 51 and 52. Further, the teeth gap portions 53 communicates via the extremely slight gaps with the shaft hole 52*b* of the inner rotor 52. Accordingly, the sliding (contact) surface between the outer and inner rotors 51 and 52 and the second side plate 72 can be filled with fluid to reduce the torque loss. In particular, as shown in FIG. 7 illustrating pressure distributions between the high and low pressure portions, in a case that the extremely slight gaps extend radially to bridge the high and low pressure portions (regions), pressure difference between the high and low pressure portions causes fluid to flow into the extremely slight gaps so that lubrication of the sliding surface is more enhanced.

Further, since the brake fluid receives a centrifugal force acting radially according to the rotation of the rotors 51 and 52 and the direction in which the extremely slight gaps extend coincides with the direction in which the centrifugal force acts, the radially extending grinding stripes serve to easily supply the fluid to the sliding surface between the rotors 51 and 52 and the second side plate 72.

As mentioned above, since the axial end surfaces 51*a*, 51*b* and 72*b* of the outer and inner rotors 51 and 52 and the second side plate 72, which serve as the mechanical sealing, are provided with the radially extending grinding stripes, the friction of the sliding surface becomes smaller with the fluid easily supplied thereto via the extremely slight gaps so that the torque loss of the rotary pump 10 is reduced.

(Second embodiment)

Figure 8A:
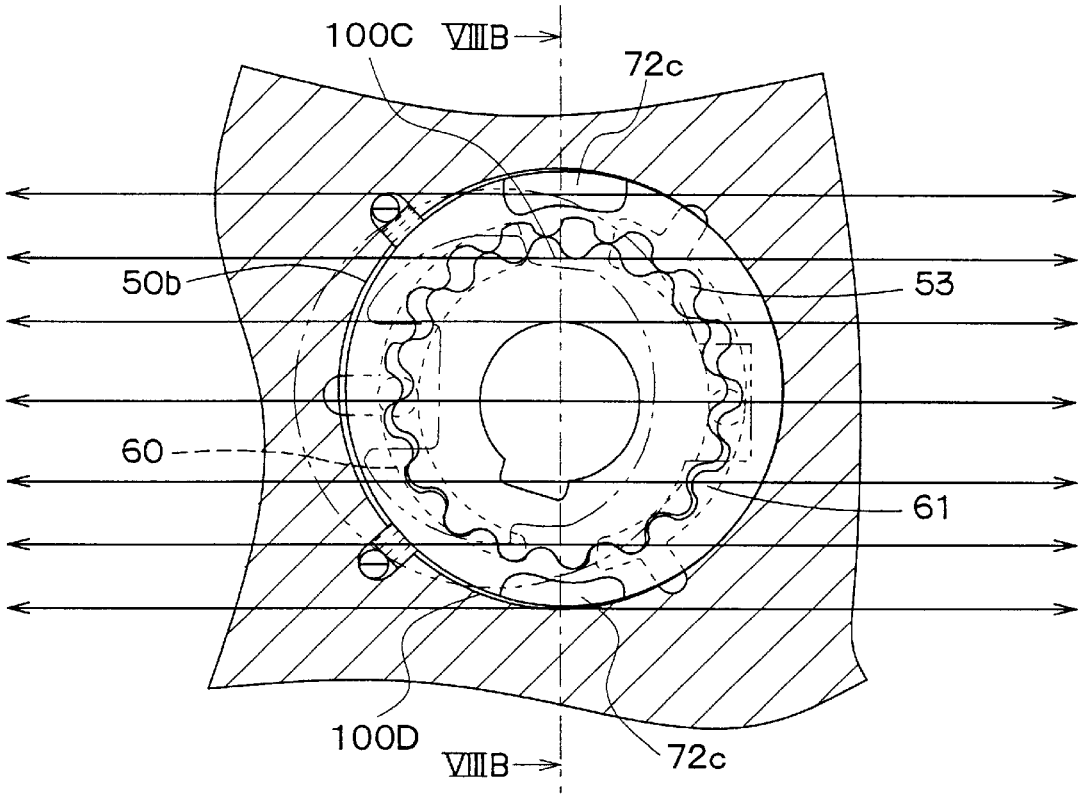
FIG. 8A is a schematic sectional view of a totary pump according to a second embodiment of the present invention.
Figure 8B:
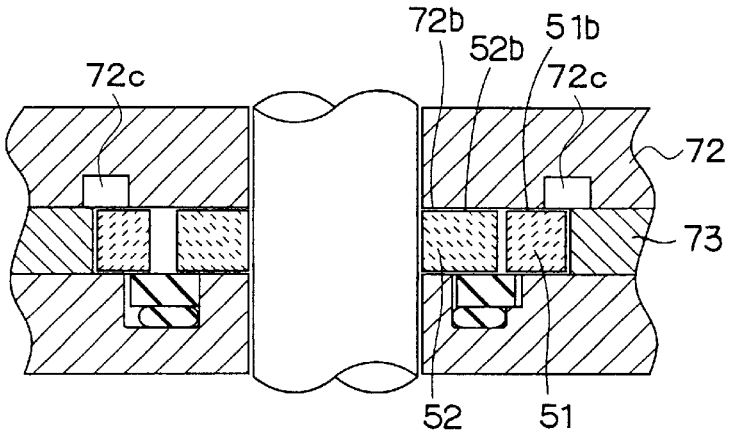
FIG. 8B is a cross sectional view taken along a line VIIIB—VIIIB of FIG. 8A.
Figure 9:
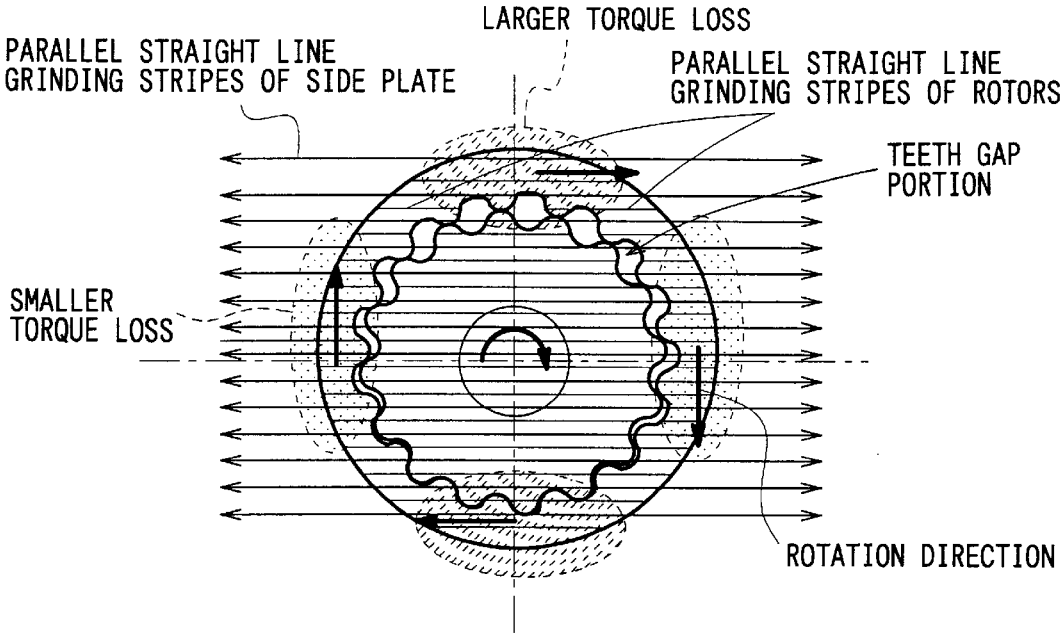
FIG. 9 is a schematic view showing torque loss as a result of experimental test.

In a rotary pump according to a second embodiment, the axial end surfaces 51*b* and 52*b* of the outer and inner rotors 51 and 52 are provided with the normal grinding stripes extending straight in parallel and the axial end surface 72*b* of the second side plate 72 is also provided with the normal grinding stripes extending straight in parallel in a direction of connecting the intake port 60 and the discharge port 62, as shown in FIG. 8A. The parallel straight extending grinding stripes are formed on entire surfaces of the axial end surfaces 51*b* and 52*b* and on surfaces of the axial end surfaces 72*b* opposed not only to the outer and inner rotors 51 and 52 but also to the center plate 73.

Further, the second side plate 72 is provided at designated portions thereof (arch shaped portions) with fluid grooves 72*c*. The designated portions of the second side plate 72 are portions of the axial end surface 72 opposed to the axial end surface 51*b* of the outer rotor 51 where the lines of the grinding stripes penetrate in straight from a point of the outer circumference gap 50*b* of the outer rotor 51 to another point thereof without crossing the teeth gap portions 53. At the designated portions defined above, the torque loss is higher, in particular, when the parallel straight lines of the grinding stripes of the outer rotor 51 and those of the second side plate 72 coincide with each other according to the rotations of the outer and inner rotors 51 and 52, because concave and convex portions on the axial end surfaces 51*b*, 52*b*, 72*b* due to the grinding stripes are filled with each other and the extremely slight gaps formed at the designated portions by the grinding stripes of the outer rotor 51 and the second side plate 72 are not only minimized but also not opened to the teeth gap portions 53 so that fluid supply from the teeth gap portions 53 to the designated portions is restricted. The formation of the fluid grooves 72*c* results in diminishing an area of contact surfaces between the outer rotor 51 and the second side plate 72 and, thus, reducing the contact frictional resistance therebetween so that the torque loss of the pump 10 becomes smaller. Further, the fluid grooves can store the fluid and serve to supply the fluid to adjacent contact surfaces between the outer rotor 51 and the second side plate 72 so that the torque loss is more reduced.

Instead of the grinding stripes extending straight in right and left directions in FIG. 8A, the second side plate 72 may be provided with the grinding stripes extending straight in any directions, for example, in up and down directions in FIG. 8A. In this case, the designated portions where the fluid grooves 72*c* are formed are the portions of the axial end surface 72 opposed to the axial end surface 51*b* of the outer rotor 51 where the lines of the grinding stripes penetrate in straight from a point of the outer circumference gap 50*b* of the outer rotor 51 to another point thereof without crossing the teeth gap portions 53, as defined above.

Further, instead of or in addition to the fluid grooves 72*c* formed in the second side plate 72, the fluid grooves may be formed in the outer rotor 51 at the designated portions thereof where the lines of the grinding stripes of the outer rotor 51 penetrate in straight from a point of the outer circumference gap 50*b* of the outer rotor 51 to another point thereof without crossing the teeth gap portions 53. At the designated portions of the outer rotor 51, the torque loss is higher when the parallel straight lines of the grinding stripes of the outer rotor 51 coincide with the parallel straight lines of the grind stripes of the second side pate 72, even if those of the second side plate 72 extend in any directions, according to the rotations of the outer and inner rotors 51 and 52.

(Third embodiment)

In a rotary pump 10 according to a third embodiment, the grinding strips formed on the axial end surface 72*b* of the second side plate 72 extend radially and the grinding strips formed on the axial end surfaces 51*b* and 52*b* of the outer and inner rotors 51 and 52 extend circumferentially.

In this case, the grinding stripes of the second side plate 72 crosses substantially perpendicularly to the grinding stripes of the outer and inner rotors 51 and 52 in every rotation phase where the outer and inner rotors 51 and 52 rotate. Accordingly, an area of the contact surface between the outer and inner rotors 51 and 52 and the second side plate 72 is relatively small since concave and convex portions on the axial end surfaces 51*b*, 52, 72*b* due to the grinding stripes can form adequate size of extremely slight gaps because the grinding stripes of the outer and inner rotors 51 and 52 and the second side plate 72 cross each other. Contact frictional resistance at any portion of the contact surface between the outer and inner rotors 51 and 52 and the second side plate 72 in any rotating phase according to the third embodiment is smaller than that at the designated portions when the straight lines of the grinding stripes of the outer and inner rotors 51 and 52 and the second side plate 72 coincide with each other according to the second embodiment. That is, the contact frictional resistance according to the third embodiment is same to that at portions other than the designated portions when the straight lines of the grinding stripes of the outer and inner rotors 51 and 52 and the second side plate 72 do not coincide with each other according to the second embodiment.

According to the third embodiment, the contact frictional resistance at any portion is relatively small and not variable according to the rotation of the outer and inner rotors 51 and 52 so that there are no contact surface portions at which the frictional resistance suddenly increases and to which surplus torque is suddenly applied according to the rotation thereof, resulting in less frictional wear of the contact surfaces and no performance reduction of the pump 10 based on metal deformation of the rotors and the second side plate 51, 51 and 72 due to frictional heat.

Instead of the radially extending grinding stripes of the second side plate 72 and the circumferentially extending grinding stripes of the outer and inner rotors 51 and 52, the second side plate 72 may be provided with circumferentially extending grinding stripes and the outer and inner rotors 51 and 52 with radially extending grinding stripes. An advantage of the latter is substantially same to that of the former, as mentioned above.

(Fourth embodiment)

In any of the first and third embodiments, the axial end surface 72*b* of the second side plate 72 may be provided at given portions corresponding to the first and second closed teeth gap portions 53*a* and 53*b* (portions corresponding to the wider width portion 100C and 100D of the side sealing member 100) with fluid grooves 72*c*. The sliding resistance at those given portions is relatively high since the side sealing member 100 is in direct contact with and presses against surfaces of the outer and inner rotors 51 and 52 corresponding to those given portions. The fluid grooves serve to improve the lubrication of the fluid at those given portions and reduce the torque loss.

The fluid grooves at those given portion are applicable not only to the rotary pump according to the embodiments mentioned above but also to a rotary pump whose grinding stripes of the axial end surfaces 51*b* and 52*b* of the outer and inner rotors 51 and 52 and the axial end surface 72*b* of the second side plate 72 have any pattern of lines, whether or not the lines extend in any direction, for a purpose of reducing the torque loss.

Figure 10A:
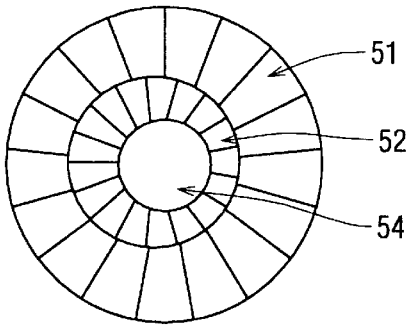
FIG. 10A is a conceptual view showing grinding stripes of outer and inner rotor according to a first modification of the first embodiment.
Figure 10B:
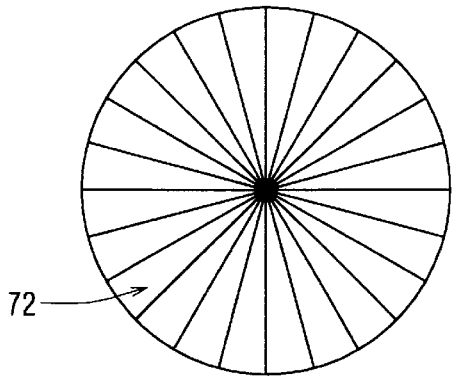
FIG. 10B is a conceptual view showing grinding stripes of a second side plate according to the first modification of the first embodiment.

Further, instead of the grinding stripes extending radially in a curve in the first embodiment, the axial end surfaces 51*b* and 52*b* of the outer and inner rotors 51 and 52 and the axial end surface 72*b* of the second side plate 72 may be provided with grinding stripes extending from each center axis thereof radially outward in straight, as shown in FIGS. 10A and 10B. Radial line grinding stripes, at any pattern of lines in straight or in a curve, serve to promote the fluid lubrication due to the centrifugal force based on the rotation of the rotors 51 and 52.

Figure 11A:
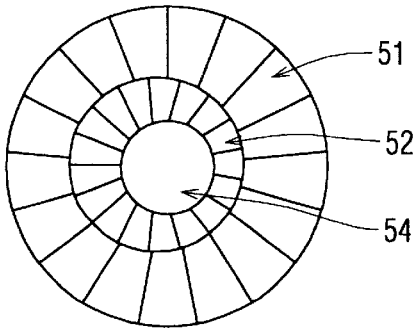
FIG. 11A is a conceptual view showing grinding stripes of outer and inner rotor according to a second modification of the first embodiment.
Figure 11B:
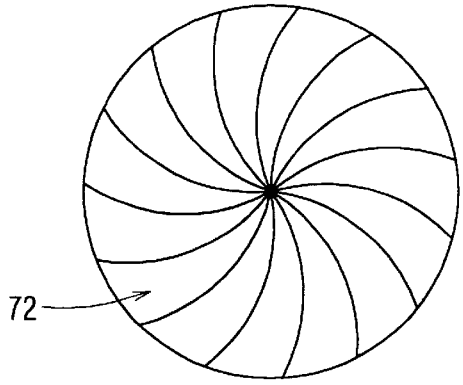
FIG. 11B is a conceptual view showing grinding stripes of a second side plate according to the second modification of the first embodiment.

Furthermore, as shown in FIGS. 11A and 11B, one of the axial end surfaces 72*b*, 51*b* and 52*b* of the second side plate 72 and the outer and inner rotors 51 and 52 may be provided with grinding stripes extending radially in a curve and the other thereof may be provided with grinding stripes extending radially in straight. Since each line of the grinding stripes extending radially in a curve never coincide with and always cross each line of the grinding stripes extending radially in straight in every rotation phase of the rotors 51 and 52, actual contact area between the axial end surfaces 72*b*, 51*b* and 52*b* is reduced by the sliding stripes and is smaller so that contact frictional resistance and the torque loss is smaller.

Figure 12:
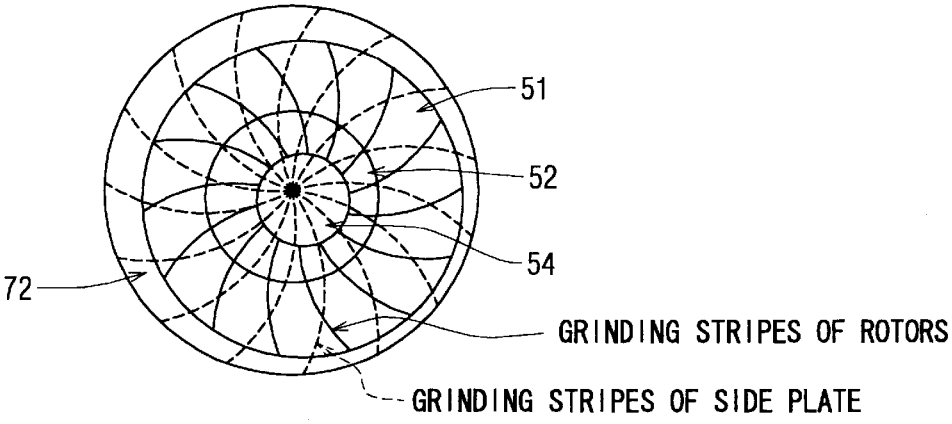
FIG. 12 is a conceptual view showing grind stripes of outer and inner rotors and a second plate according to a third modification of the first embodiment.

Moreover, as shown in FIG. 12 in which solid lines show grinding stripes of the axial end surfaces 51*b* and 52*b* of the outer and inner rotors 51 and 52 and dotted lines show grinding stripes of the axial end surface 72*b* of the second side plate 72, each line of the radial line grinding stripes of the axial end surface 72*b* may be curved in a direction opposite to each line of the radial line grinding stripes of the axial end surfaces 51*b* and 52*b*.

Figure 13:
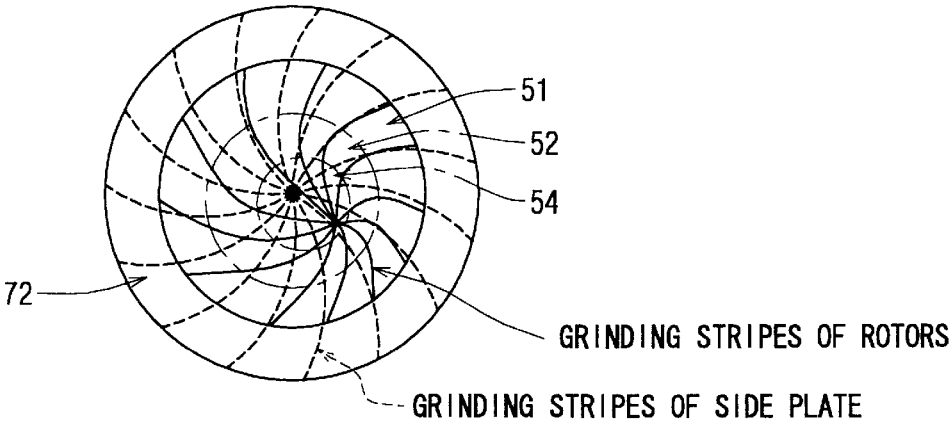
FIG. 13 is a conceptual view showing grind stripes of outer and inner rotors and a second plate according to a fourth modification of the first embodiment.

Still further, as shown in FIG. 13 in which solid lines show grinding stripes of the axial end surfaces 51*b* and 52*b* of the outer and inner rotors 51 and 52 and dotted lines show grinding stripes of the axial end surface 72*b* of the second side plate 72, one of the radial line grinding stripes of the axial end surfaces 51*b* and 52*b* and the radial line grinding stripes of the axial end surface 72*b* extend from a first center point radially outward in a curve and the other thereof extend from a second center point, which is not coincident with the first center point, radially outward in a curve.

Further, instead of the fluid grooves 72*c* formed in the second side plate 72 at the designated portions where the lines of the grinding stripes of the axial end surface 72*b* penetrate in straight from a point of the outer circumference gap 50*b* of the outer rotor 51 to another point thereof without crossing the teeth gap portions 53, the fluid groove 72*c* may be provided at any position of the axial end surface 72*b*, regardless whether the grinding stripes extend in any direction, as far as the fluid groove 72 is formed to communicate with one of high and low pressure regions of the outer circumference gap 50*b* of the outer rotor 51 but never communicate with any of the teeth gap portions 53 without bridging the high and low pressure regions of the outer circumference gap 50*b* of the outer rotor 51. The fluid groove bypassing the outer circumference sealing member 80 or 81 is not adequate because pressure difference between the high and low pressure regions of the outer circumference gap 50*b* is cancelled.

It is preferable that the fluid groove 72*c* is provided at a portion radially inside the high pressure region of the outer circumference 50*b*. A portion radially inside the low pressure region of the outer circumference 50*b* can be more or less lubricated by the fluid leaked through the side clearance from the high pressure region to the low pressure region. Though a portion radially inside the high pressure region of the outer circumference 50*b* and radially outside the teeth gap portions 53 communicating with the intake port 60 (that is, low pressure region) can be lubricated, even if mechanically sealed as shown in FIG. 7, due to the pressure difference between the high pressure region of the outer circumference gap 50*b* and the low pressure region of the teeth gap portions 53, the fluid groove 72*c* may be formed at this portion in view of further enhancing lubrication thereon.

It is more preferable that the fluid groove 72*c* is formed at a position radially inside the high pressure region of the outer circumference gap 50*b* and radially outside the teeth gap portions 53 communicating with the discharge port 61 (that is, high pressure portion). The fluid lubrication of this position is very poor because the fluid hardly flows through the side clearance due to no pressure difference between the outer circumference gap 50*b* and the teeth gap portions 53 radially opposed to each other. Accordingly, the formation of the fluid groove 72*c* serves to reduce an area of the contact surface at this position between the axial end surface 72*b* of the second side plate 72 and the axial end surface 51*b* of the outer rotor 51 so that contact frictional resistance is lower by the area reduced at this position.

In the embodiments mentioned above, it is defined that the maximum volume closed gap portion 53*a* or the minimum volume closed gap portion 53*b* is the portion where the brake fluid volume is the largest or the smallest among the plurality of the teeth gap portions 53 and the maximum and minimum volume closed gap portions 53*a* and 53*b* communicate neither with the intake port 60 nor with the discharge port 61. However, in consideration of actual designing or manufacturing feasibility, there is a possibility that portions communicating neither with the intake port 60 nor with the discharge port 61 are not the maximum and minimum volume closed gap portions but portions immediately adjacent thereto. Accordingly, the maximum and minimum volume closed gap portions and, the case may be, the portion immediately adjacent thereto are defined as first and second closed gap portions 53*a* and 53*b* whose teeth gap volume are nearly largest and smallest, respectively.

What is claimed is:

1. A rotary pump comprising:

an outer rotor having first and second axial end surfaces, the outer rotor being provided at an inner circumference thereof with inner teeth;

an inner rotor having first and second axial end surfaces, the inner rotor being provided at an outer circumference thereof with outer teeth in mesh with the inner teeth so as to constitute a plurality of teeth gap portions therebetween;

a drive shah fitted to the inner rotor for rotating the inner rotor;

a casing provided with intake and discharge ports and a rotor room having first and second inner side surfaces opposed to each other, the inner and outer rotors being rotatably contained in the rotor room in such a manner that the first and second inner side surfaces of the rotor room face the first and second axial end surfaces of the outer and inner rotors, respectively, and the intake and discharge ports communicating with the teeth gap portions so that fluid is sucked from the intake port, compressed through the teeth gap portions and discharged from the discharge port when the drive shaft is driven; and a side sealing member disposed between the first axial end surfaces of the cuter and inner rotors and the first inner side surface of the rotor room to urge the outer and inner rotors toward the second inner side surface of the rotor room so that not only a side clearance between the first axial end surfaces of the outer and inner rotors and the first inner side surface of the rotor room is sealed but also a side clearance between the second axial end surfaces of the outer and inner rotors and the second inner side surface of the rotor room is sealed with a mechanical seal due to direct contact therebetween, wherein both of the second axial end surfaces of the outer and inner rotors and the second inner side surface of the rotor room are provided on entire surfaces thereof with radial line grinding stripes.

2. A rotary pump according to claim 1, wherein the radial line grinding stripes extend radially in a straight line.

3. A rotary pump according to claim 1, wherein the radial line grinding stripes extend radially in a curve.

4. A rotary pump according to claim 1, wherein the radial line grinding stripes extend radially in a curve and each line of the radial line grinding stripes of the second inner side surface of the rotor room is curved in a direction opposite to each line of the radial line grinding stripes of the second axial end surfaces of the outer and inner rotors.

5. A rotary pump according to claim 1, wherein one side of the radial line grinding stripes of the second axial end surfaces of the outer and inner rotors and the radial line grinding stripes of the second inner side surface of the rotor room extend radially in straight and the other side thereof extend radially in a curve.

6. A rotary pump according to claim 1, wherein one side of the radial line grinding stripes of the second axial end surfaces of the outer and inner rotors and the radial line grinding stripes of the second inner side surface of the rotor room extend from a first center point radially outward in a curve and the other side thereof extend from a second center point, which is not coincident with the first center point, radially outward in a curve.

7. A rotary pump according to claim 1, included in a brake apparatus comprising:

a brake fluid pressure generating device for generating fluid pressure in accordance with brake pedal depression;

a braking force producing device for producing braking force on wheels;

a main conduit connected to the brake fluid pressure generating device for transmitting the fluid pressure to the braking force producing device; and an auxiliary conduit connected to the brake fluid pressure generating device, wherein the rotary pump sucks brake fluid through the auxiliary conduit and discharges brake fluid through the main conduit for increasing the fluid pressure applied to the braking force producing device.

* * * * *

UNITED STATES PATENT AND TRADEMARK OFFICE

CERTIFICATE OF CORRECTION

PATENT NO. : 6,749,272 B2
DATED : June 15, 2004
INVENTOR(S) : Kazunori Uchiyama et al.

It is certified that error appears in the above-identified patent and that said Letters Patent is hereby corrected as shown below:

Title page,
Item [73], Assignee, should read
-- Assignees: Denso Corporation, Kariya (JP) and Nippon Soken, Inc., Nishio, (JP) --

Signed and Sealed this

Twenty-sixth Day of April, 2005

JON W. DUDAS
*Director of the United States Patent and Trademark Office*